United States Patent [19]

Jimenez et al.

[11] Patent Number: 4,996,722

[45] Date of Patent: Mar. 5, 1991

[54] REDUCED STRIKE THROUGH SURGICAL GARMENT AND METHOD OF MANUFACTURE

[75] Inventors: Isabel M. Jimenez; Manuel M. Arevalo, both of Chihuahua, Mexico

[73] Assignee: Baxter International Inc., Deerfield, Ill.

[21] Appl. No.: 407,975

[22] Filed: Sep. 15, 1989

[51] Int. Cl.[5] ..... A41D 13/00; A41D 27/24

[52] U.S. Cl. ..... 2/51; 2/59; 2/114; 2/125; 2/275

[58] Field of Search ..... 2/51, 59, 60, 113, 114, 2/115, 123, 124, 125, 275, 2.1 R

[56] References Cited

U.S. PATENT DOCUMENTS

| | | | |
|---|---|---|---|
| 1,195,565 | 8/1916 | Davidson | 2/275 X |
| 1,208,193 | 12/1916 | Nightingale | 2/275 X |
| 1,247,072 | 11/1917 | Berger, Jr. | 2/275 X |
| 1,268,059 | 5/1918 | Sandford | 2/275 |
| 1,500,097 | 7/1924 | Abraham | 2/275 |
| 2,022,878 | 12/1935 | Berger | 2/123 |
| 2,234,582 | 3/1941 | Schneider | 2/59 X |
| 2,631,291 | 3/1953 | Lockett | 2/123 |
| 2,941,577 | 6/1960 | Roseman | 2/275 |
| 3,026,225 | 3/1962 | Ostby, Jr. | 2/275 |
| 3,090,047 | 5/1963 | De Grazia | 2/275 |
| 3,106,718 | 10/1963 | Raab | 2/125 X |
| 3,868,728 | 3/1975 | Krzewinski | 2/114 |
| 4,504,977 | 3/1985 | King et al. | 2/114 X |
| 4,504,978 | 3/1985 | Gregory et al. | 2/114 X |
| 4,546,497 | 10/1985 | Ono et al. | 2/275 X |
| 4,586,196 | 5/1986 | White | 2/114 |
| 4,604,152 | 8/1986 | Liukko | 2/275 X |
| 4,829,602 | 5/1989 | Harreld et al. | 2/51 |

FOREIGN PATENT DOCUMENTS

| | | | |
|---|---|---|---|
| 886765 | 10/1943 | France | 2/275 |
| 979829 | 1/1965 | United Kingdom | 2/275 |

*Primary Examiner*—Werner H. Schroeder
*Assistant Examiner*—Jeanette E. Chapman
*Attorney, Agent, or Firm*—Kay H. Pierce; Paul C. Flattery

[57] ABSTRACT

A surgical garment having a sleeve reinforcement that reduces the fluid strike through. The sleeve reinforcement is wider than the sleeve panel. The sleeve seam is sewn without the sleeve reinforcement. The edges of the sleeve reinforcement are then glued in an overlapping manner over the sleeve seam.

2 Claims, 4 Drawing Sheets

FIG. 1
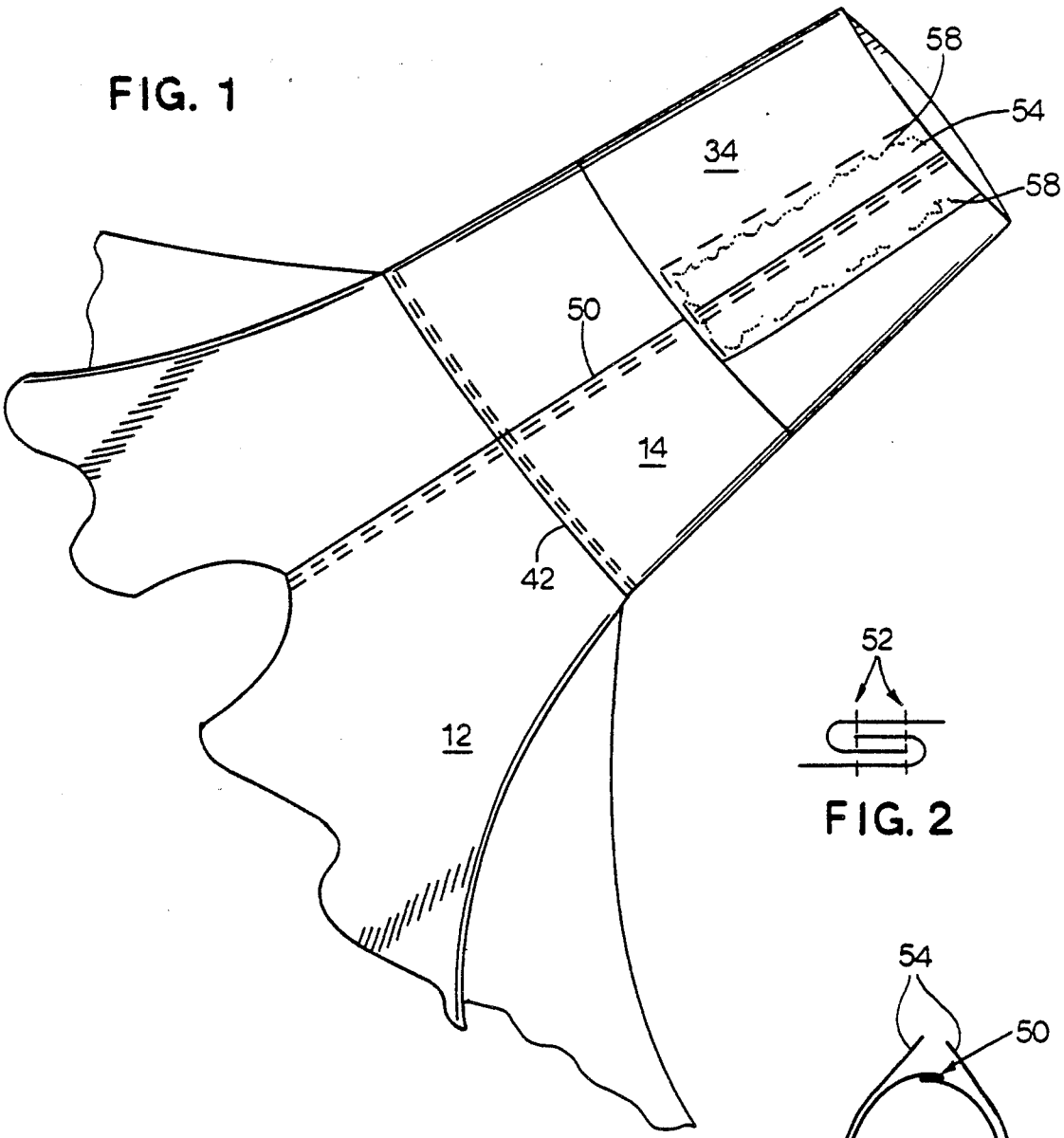
FIG. 2
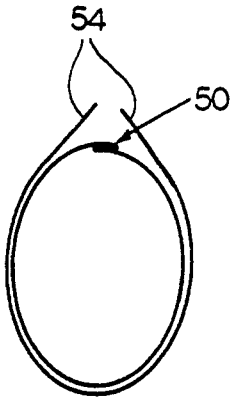
FIG. 6
FIG. 7
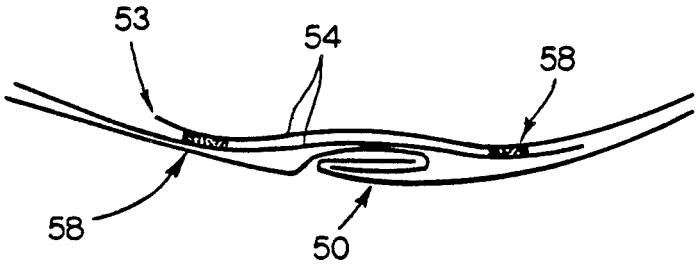

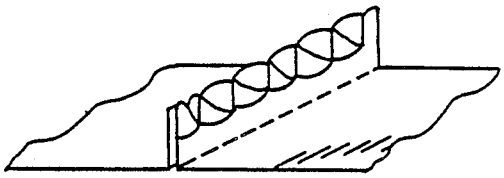
FIG. 9A
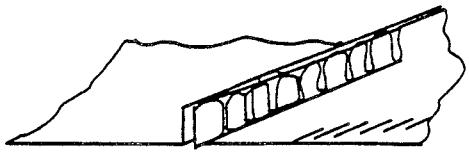
FIG. 9B
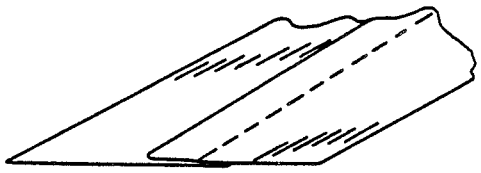
FIG. 9C
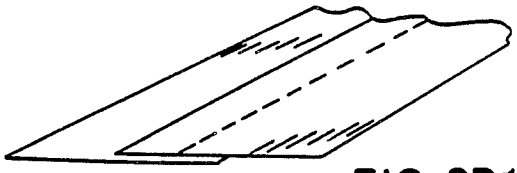
FIG. 9D1
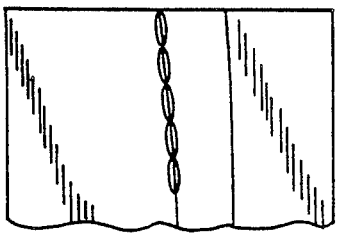
FIG. 9D2

REDUCED STRIKE THROUGH SURGICAL GARMENT AND METHOD OF MANUFACTURE

BACKGROUND OF THE INVENTION

The present invention relates to a surgical garment and method manufacture. More specifically, the present invention relates to a surgical garment having a reinforcement that overlaps the seams of the garment.

Hospital personnel engaging in surgical procedures generally wear sterile garments, such as gowns, to reduce strike through of the patient's body fluids. These garments may be made of a nonwoven disposable fabric or a woven reusable fabric.

Fluid strike through is undesirable because it may cause potentially contaminated fluids to contact the surgeon and other personnel and may also cause cross contaminated of the patient. The medical community has become more aware of the problems and dangers associated with contaminated body fluids because of communicable diseases, such as hepatitis and acquired immune deficiency.

With certain types of operations, such as eye surgery, the fluids are minimal and surgical gowns made of woven or nonwoven materials may be used without reinforcements.

However, for surgery that crates a great deal of fluid challenge, such as abdominal surgery, it is necessary to reinforce certain parts of the gown with a fluid impervious or resistant material. One reinforcement material that is commonly used is rayon laminated to a polyethylene film. The rayon makes the reinforcement material soft while the polyethylene film makes the reinforcement impervious to fluids.

Panels of this reinforcement material are generally added to the front of the gown and also to the lower portion of the sleeves. To assemble the prior art surgical garment, the front reinforcement is glued to the body panel material, and the sleeve reinforcement is glued to the sleeve material. The body panel and sleeve panels are sewn together with the garment right side out. The garment is then turned inside out so that the cuffs can be sewn to the garment.

Because the prior art sleeve reinforcement was glued to the sleeve material and the entire sleeve assembly sewn as one piece, these sleeves still had a problem with fluid strike through, especially at the sleeve seams.

Various types of seams are shown in FIGS. 9A through 9D2. Because the needle must pierce the fabric to sew the seam, there is necessarily a series of holes in the fabric panels. These holes may allow body fluids or irrigating fluids used in the procedure to seep through the holes created by the seam.

This strike through is also a problem even where a stronger seam has been created by folding the panel seam edges over each other and stitching through all fabric layers to provide a seam with a reduced tendency to rip, as shown in FIGS. 2. Since the stitches are sewn through all layers of fabric, i.e. through the fabric and the reinforcement and their respective seam allowances, the holes made by the needle still provide a direct route for fluid to travel from one side of the garment to the other.

Thus, there is a need for an improved sewing method for reducing strike through at the seams of surgical garments.

SUMMARY OF THE INVENTION

The present invention provides a reduced strike through surgical garment and a method of manufacturing the garment. The sleeve reinforcement is cut 2" wider than the sleeve panel. The sleeve reinforcement is placed in the center of the sleeve and held in place by two glue lines between the sleeve panel and the sleeve reinforcement.

The body panel and the two sleeve panels are sewn together with a double chain stitch. The sleeve reinforcement is not included in this seam. This assembly of the garment can occur either inside out or right side out. After the assembly operation, the unsewn edges of the sleeve reinforcement are glued over the sleeve seams so that two layers of reinforcement cover and protect the sleeve seams against strike through. The sleeve reinforcements are held in place over the sleeve seam by glue lines applied to both sides of the unsewn reinforcement. The cuffs are now sewn to the sleeves with the gown inside out.

Accordingly, it is an advantage of the present invention to provide a surgical garment with sleeve seams covered by two layers of fluid impervious reinforcement.

Another advantage of the present invention is that it reduces the defects of unfolded seams. In the prior art assembly method, the thickness of the garment panels and reinforcement panels made it difficult for the operator to properly feed the seam to the folder, so that the finished seam was often incorrect.

A further advantage of the present invention is that excess thread and loose threads are reduced and/or covered by the reinforcement material. Moreover, an advantage of the present invention is that the garment no longer needs to be turned inside out to assemble the cuffs since all of the garment assembly takes place with the garment inside out.

Furthermore, an advantage of the present invention is the elimination of problems due to sewing the polyethylene reinforcement. In the prior art method the garment panels and reinforcement panels were sewn together. The friction between the polyethylene and the needle generated heat that melted the poly compound which then adhered to the needle. The thread often broke causing open seams, needle holes and skipped threads and requiring rework of the garment.

A further advantage of the present invention is the elimination of problems due to sewing the many layers of sleeve panels, sleeve reinforcements and seam allowances of both.

Additional features and advantages are described herein, and will be apparent from the detailed description of the presently preferred embodiment and from the drawings.

BRIEF DESCRIPTION OF THE DRAWINGS

FIG. 1 is a perspective view of a portion of a fully assembled surgical garment and the sleeve reinforcement inside out.

FIG. 2 is a cross-sectional schematic view of a sleeve seam with a double needle chain stitch.

FIG. 6 is a cross-sectional view of a sewn sleeve panel and a sleeve reinforcement being assembled.

FIG. 7 is a cross-sectional view of a finished sleeve panel and a sleeve reinforcement seam.

FIG. 9A is a perspective view of a seam with a safety stitch comprising a single needle chain stitch and an overlock stitch.

FIG. 9B is a perspective view of a serged seam with an overlock stitch.

FIG. 9C is a perspective view of a seam with a single needle lock stitch.

FIG. 9D1 is a perspective view of a seam with a single needle chain stitch.

FIG. 9D2 is a top view of the seam of FIG. 9D1.

DETAILED DESCRIPTION OF A PRESENTLY PREFERRED EMBODIMENT

Figure 8:
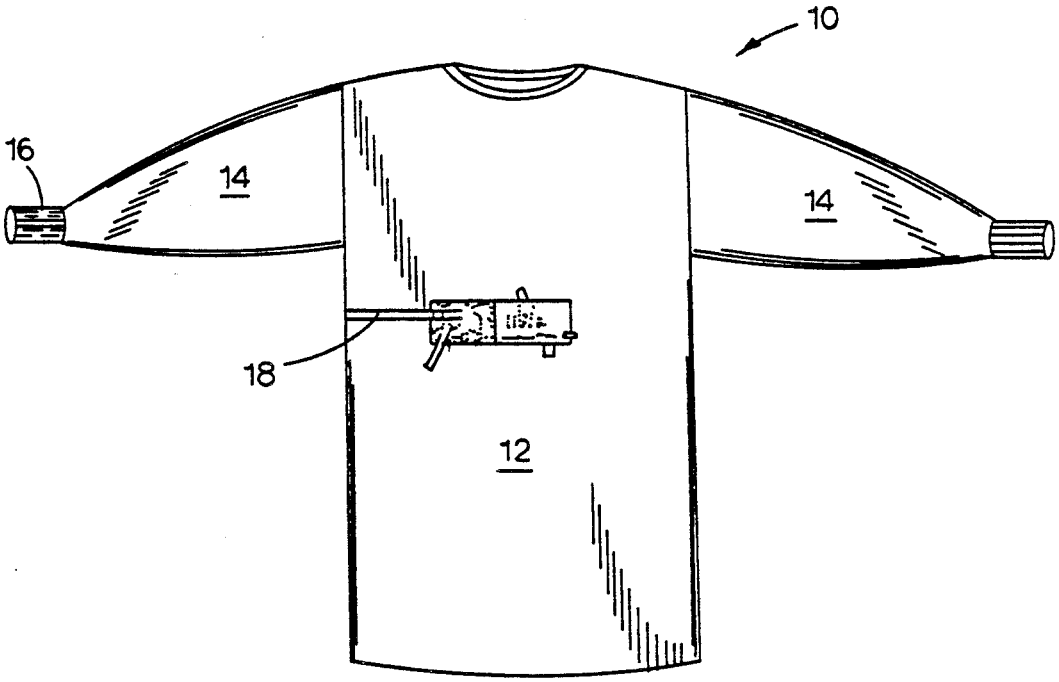
FIG. 8 is a front view of a fully constructed surgical garment.

Referring to FIG. 8, the surgical garment of the present invention is generally indicated as 10. This surgical garment 10 includes a body panel 12, sleeve panels 14, cuffs 16 and belt 18.

Body panel 12 comprises a front portion 22 and back portions 24. When garment 10 is worn the back panels 24 are overlapped behind the wearer and the garment tied with belt 18 to close the garment.

Figure 3:
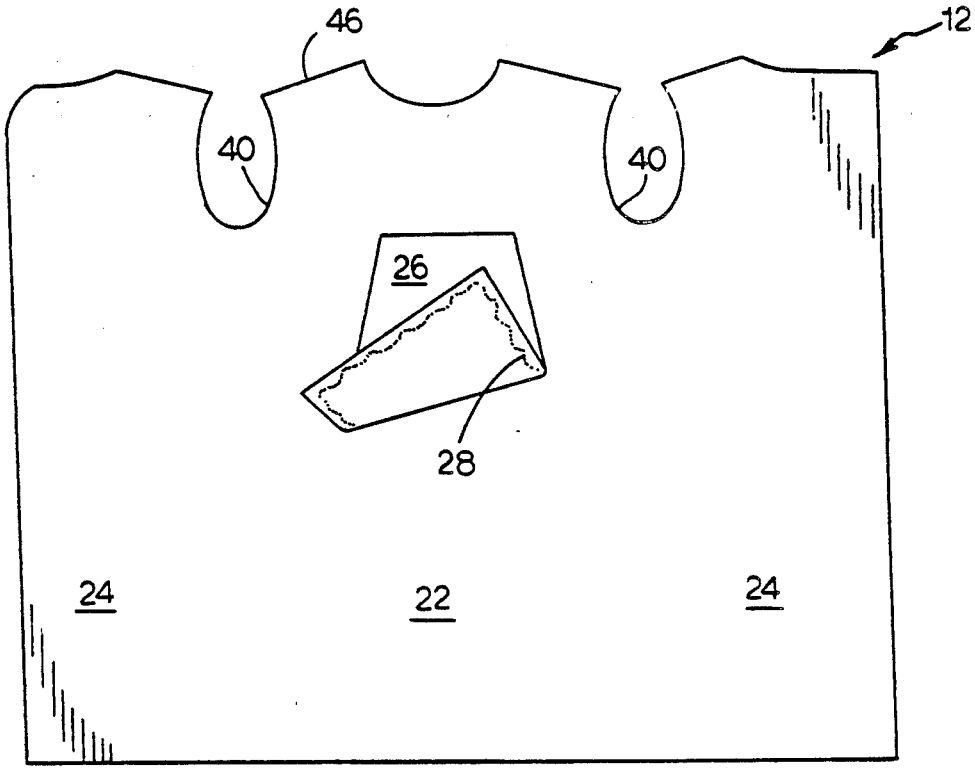
FIG. 3 is a top view of a body panel with a front reinforcement being applied.
Figure 4:
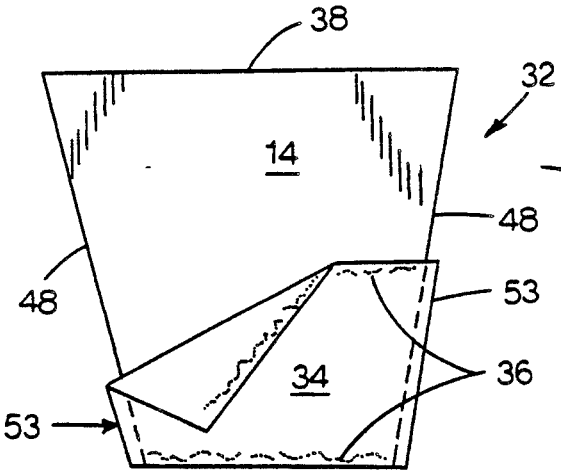
FIG. 4 is a top view of a sleeve panel with a sleeve reinforcement being applied.

Front reinforcement 26 is adhered to the body panel front portion 22 by glue lines 28. The sleeve assembly 32 is prepared by adhering a sleeve reinforcement 34 to sleeve panel 14 by means of glue lines 36, as shown in FIG. 4.

The sleeve assembly 32 is secured to body panel 12 by sewing the shoulder edge 38 of sleeve assembly 32 to the arm hole 40 by a double needle chain stitch to create an arm hole seam 42. Although the embodiment described herein is manufactured by using a double needle chain stitch, the garment and method of manufacture that are the subject of this application may be made of using any type of stitching or other assembly methods.

The main assembly of surgical garment 10 is then completed by sewing the shoulders 46 together and sleeve edges 48 together to create sleeve seam 50. The sleeve seam 50 is made by overlapping the sleeve edges 48 with one another and shoulders 46 with one another and sewing with a double needle chain stitch to create two rows of stitches 52 through all layers of the sleeve and seam allowances as shown in FIG. 2. The holes created by the needles present a pathway for fluid to travel from the outside to the inside of the surgical garment 10 or vice versa.

In the prior art the sleeve reinforcement was the same width as the sleeve panel and was glued so that both pieces were treated as one. In the prior art the seam allowances of both the sleeve reinforcement and the sleeve panel were folded and the double rows of stitching 52 were passed through both the panel material and the reinforcement material. This greatly reduced the effectiveness of the fluid impervious reinforcement panel at the sleeve seam 50.

Figure 5:
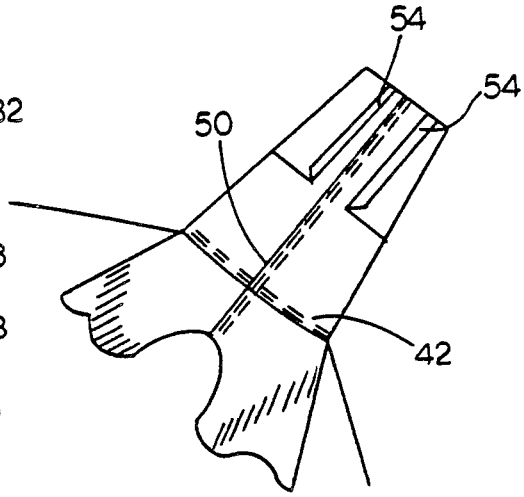
FIG. 5 is a side view of a sewn sleeve panel prior to the sleeve reinforcement being fully assembled.

As shown in FIG. 4, the sleeve reinforcement 34 has a width between reinforcement edges 53 which is approximately 1" wide on each side than the sleeve panel 14. When the sleeve edges 48 and shoulders 46 are sewn together, the garment assembler must take care that the reinforcement ends 54 of the sleeve reinforcement 34 are not included in the seam, as shown in FIG. 5. After the sleeve seam 50 has been made, the reinforcement ends 54 are laid over the seam as shown in FIGS. 6 and 7. The reinforcement ends are secured by a glue line 58.

Because there are two layers of fluid impervious reinforcement fabric covering the sleeve seam 58, passage of fluids through this area is greatly reduced. This type of reinforcement may be used with any seam, and is particularly effective where the stitches pass through all layers of fabric and seam allowances. The reinforcement may be used with a garment assembly comprises one panel with its edges being joined together in a seam or with a garment assembly having two panels joined by a seam. As discussed above, it is extremely beneficial for this design to be used with seams of the surgical garment that are exposed to large amounts of fluid in surgical procedures.

It should be understood that various changes and modifications to the preferred embodiment described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. A surgical garment comprising:

a garment assembly having a first predetermined width between a first panel edge and a second panel edge, said garment assembly having a seam adjacent the first and second panel edges:

a moisture-resistant reinforcement panel having a second predetermined width between a first reinforcement edge and a second reinforcement edge, the second predetermined width being greater than the first predetermined width, said reinforcement panel having a reinforcement end adjacent each reinforcement edge, said reinforcement panel being adhered to said garment assembly, and both of the reinforcement ends overlap each other while also overlying the seam.

2. A surgical garment as claimed in claim 1, wherein the reinforcement ends are secured to said reinforcement panel.

* * * * *